US006729500B1

(12) United States Patent
Dobbs et al.

(10) Patent No.: US 6,729,500 B1
(45) Date of Patent: May 4, 2004

(54) TWIRLING DIP TUBE

(75) Inventors: Douglas B. Dobbs, Yorba Linda, CA (US); Kevin O'Neill, Wrightwood, CA (US)

(73) Assignee: Saint-Gobain Calmar, Inc., City of Industry, CA (US)

( * ) Notice: Subject to any disclaimer, the term of this patent is extended or adjusted under 35 U.S.C. 154(b) by 0 days.

(21) Appl. No.: 10/445,186

(22) Filed: May 27, 2003

(51) Int. Cl.[7] ..... B67D 17/04

(52) U.S. Cl. ..... 222/78; 222/321.7; 222/321.9; 446/267

(58) Field of Search ..... 222/321.1–321.9, 222/192, 464.1, 464.3–524, 519, 568, 412, 548, 383.1, 385, 78, 233, 234, 235; 446/475, 268, 267; 40/406, 410; 366/247, 245, 244, 286, 289

(56) References Cited

U.S. PATENT DOCUMENTS

| | | | | | |
|---|---|---|---|---|---|
| 4,280,297 | A | * | 7/1981 | Katzman et al. | 446/183 |
| 5,915,600 | A | | 6/1999 | Bitton | 222/464.1 |
| 6,006,958 | A | | 12/1999 | Bitton | 222/464.1 |
| 6,042,022 | A | * | 3/2000 | Rogozinski et al. | 239/211 |
| 6,119,897 | A | * | 9/2000 | Boileau | 222/78 |
| 6,223,939 | B1 | | 5/2001 | Bitton | 222/78 |
| 6,276,566 | B1 | * | 8/2001 | Zaksenberg | 222/78 |
| 6,279,778 | B1 | * | 8/2001 | Ho et al. | 222/78 |
| 6,345,731 | B2 | | 2/2002 | Bitton | 222/78 |
| 6,592,007 | B2 | * | 7/2003 | Ho et al. | 222/78 |
| 2002/0030116 | A1 | * | 3/2002 | Brown | 239/59 |

* cited by examiner

*Primary Examiner*—Gene Mancene
*Assistant Examiner*—Frederick C Nicolas
(74) *Attorney, Agent, or Firm*—Dykema Gossett PLLC

(57) ABSTRACT

A fluid pump dispenser includes a spring biased pump piston having a generally hollow stem and reciprocable between pressure and return strokes within a pump cylinder therewith defining a variable volume pump chamber for dispensing fluid through a discharge opening at an outer end of the stem. The stem defines a valve controlled discharge passage leading from the pump chamber to the discharge opening. A driver nut may be mounted adjacent the pump piston and include at least one flange engaged with at least one respective spiral turn on a spindle disposed within the pump chamber to thereby rotate the spindle during reciprocation of the pump piston. A dip tube may be disposable within a container and affixed to the spindle for rotation with the spindle. A figurine may be mounted onto the dip tube for complementary rotation with the dip tube and the spindle.

30 Claims, 3 Drawing Sheets

TWIRLING DIP TUBE

BACKGROUND OF INVENTION a. Field of Invention

The invention relates generally to fluid pump dispensers, and, more particularly to a fluid pump dispenser including a twirling dip tube and a figurine mountable thereon for complementary rotation.

b. Description of Related Art

Pump dispensers for containers are well known in the art. In an effort to market such dispensers, manufacturers often provide containers with a variety of ornamental features affixed to the container or incorporated within the container design. In addition to modifying the shape of container, the pump dispenser mechanism may also be modified to include an ornamental figurine mounted thereon, such as the pump dispenser disclosed in U.S. Pat. No. 6,006,958 to Bitton (Bitton '958).

Referring to Bition '958, a pump dispenser is disclosed and includes an ornamental figurine mounted on a dip tube extending within a clear container. An actuating rod attached to a pump piston and routed through a screw cap is attached to the ornamental figurine such that the figurine reciprocates on the dip tube in an up and down motion in unison with the dispenser head.

In addition to the reciprocating figurine of Bitton '958, the prior art also includes pump dispenser designs which enable the twirling action of a figurine upon reciprocation of a dispenser head.

The aforementioned pump dispenser designs however have impractical design constraints, such as, multiple components and/or complex manufacturing requirements, and are therefore economically unfeasible to manufacture.

Accordingly, there remains a need for a pump dispenser design, which enables twirling of an ornamental figurine, which is robust in design, efficient to operate, simple to assemble and disassemble, and which is economically feasible to manufacture.

SUMMARY OF INVENTION

The invention solves the problems and overcomes the drawbacks and deficiencies of prior art pump dispenser designs by providing a novel fluid pump dispenser including a twirling dip tube.

Thus, an exemplary aspect of the present invention is to provide a fluid pump dispenser which is usable with standard containers to provide a twirling figurine.

Another aspect of the present invention is to provide a fluid pump dispenser which is robust in design, efficient to operate, simple to assemble and disassemble, and economically feasible to manufacture.

Yet another aspect of the present invention is to provide a means for disturbing and/or stirring fluid within a container.

The invention achieves the aforementioned exemplary aspects by providing a fluid pump dispenser including a spring biased pump piston having a generally hollow stem and reciprocable between pressure and return strokes within a pump cylinder therewith defining a variable volume pump chamber for dispensing fluid through a discharge opening at an outer end of the stem. The stem defines a valve controlled discharge passage leading from the pump chamber to the discharge opening. A driver nut may be mounted adjacent the pump piston and include at least one flange engaged with at least one respective spiral turn on a spindle disposed within the pump chamber to thereby rotate the spindle during reciprocation of the pump piston. A dip tube may be disposable within a container and affixed to the spindle for rotation with the spindle.

For the fluid pump dispenser described above, the spring for biasing the pump piston may be disposed within the pump cylinder to negatively bias the pump piston during the pressure stroke and positively bias the pump piston during the return stroke. A frusto-conical seal may be disposed at an end of the spindle to define a valve for controlling an inlet passage extending into the pump cylinder and configured to prevent passage of fluid into the pump cylinder during the pressure stroke and enable passage of fluid into the pump cylinder during the return stroke. The frusto-conical seal may be disposable in mating engagement with a complementary valve seat within the pump cylinder to prevent the passage of fluid into the pump cylinder during the pressure stroke. The spindle may be reciprocable during the pressure and return strokes to respectively engage and disengage the frusto-conical seal from a complementary valve seat within the pump cylinder to respectively prevent the passage of fluid into the pump cylinder during the pressure stroke and enable the passage of fluid into the pump cylinder during the return stroke. The frusto-conical seal may be engageable with a stop to thereby limit the reciprocation of the spindle during the return stroke. The stop may be the spring for biasing the pump piston. The dip tube may include a figurine mounted thereon for rotation with the spindle. The figurine may be configured to disturb fluid in the container and otherwise entertaining users of all ages. The valve controlled discharge passage may be controlled by a ball check valve.

The invention further provides a fluid pump dispenser including a spring biased piston having a generally hollow stem and reciprocable between pressure and return strokes within a pump cylinder therewith defining a variable volume pump chamber for dispensing fluid through a discharge opening at an outer end of the stem. The stem defines a valve controlled discharge passage leading from the pump chamber to the discharge opening. The fluid pump dispenser further includes means for rotating a spindle during reciprocation of the piston, and a dip tube affixed to the spindle for rotation with the spindle.

For the fluid pump dispenser described above, the spring for biasing the piston may be disposed within the pump cylinder to negatively bias the piston during the pressure stroke and positively bias the piston during the return stroke. The fluid pump dispenser further includes means for preventing passage of fluid into the pump cylinder during the pressure stroke and enabling passage of fluid into the pump cylinder during the return stroke. The means for preventing passage of fluid into the pump cylinder may include a seal disposable in mating engagement with a complementary valve seat within the pump cylinder to prevent the passage of fluid into the pump cylinder during the pressure stroke. The spindle may be reciprocable during the pressure and return strokes to respectively engage and disengage the means for preventing passage of fluid into the pump cylinder from a complementary valve seat within the pump cylinder to respectively prevent the passage of fluid into the pump cylinder during the pressure stroke and enable the passage of fluid into the pump cylinder during the return stroke. The means for preventing passage of fluid into the pump cylinder may be engageable with a stop to thereby limit the reciprocation of the spindle during the return stroke. The stop may be the spring for biasing the piston. The dip tube may be a figurine mounted thereon for rotation with the spindle. The fluid pump dispenser may be mounted onto a container and the figurine may be configured to disturb fluid in the container. The valve controlled discharge passage may be controlled by a ball check valve.

The invention yet further provides a method of twirling a dip tube operatively connected to a spring biased piston in a fluid pump dispenser. The method includes providing the spring biased piston having a generally hollow stem and reciprocating the piston between pressure and return strokes within a pump cylinder therewith defining a variable volume pump chamber for dispensing fluid through a discharge opening at an outer end of the stem. The stem defines a valve controlled discharge passage leading from the pump chamber to the discharge opening. The method further includes providing means for rotating a spindle during reciprocation of the piston and affixing the dip tube to the spindle for rotation with the spindle.

For the method described above, the method further includes providing the spring for biasing the piston within the pump cylinder to negatively bias the piston during the pressure stroke and positively bias the piston during the return stroke, and providing means for preventing passage of fluid into the pump cylinder during the pressure stroke and enabling passage of fluid into the pump cylinder during the return stroke. The means for preventing passage of fluid into the pump cylinder may include a seal disposable in mating engagement with a complementary valve seat within the pump cylinder to prevent the passage of fluid into the pump cylinder during the pressure stroke. The method yet further includes reciprocating the spindle during the pressure and return strokes to respectively engage and disengage the means for preventing passage of fluid into the pump cylinder from a complementary valve seat within the pump cylinder to respectively prevent the passage of fluid into the pump cylinder during the pressure stroke and enable the passage of fluid into the pump cylinder during the return stroke. The method also includes engaging the means for preventing passage of fluid into the pump cylinder with a stop to thereby limit the reciprocation of the spindle during the return stroke. The stop may be the spring for biasing the piston. The method further includes providing a figurine mounted on the dip tube for rotation with the spindle, mounting the fluid pump dispenser onto a container, the figurine being configured to disturb fluid in the container, and controlling the valve controlled discharge passage by a ball check valve.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENTS

Figure 1:
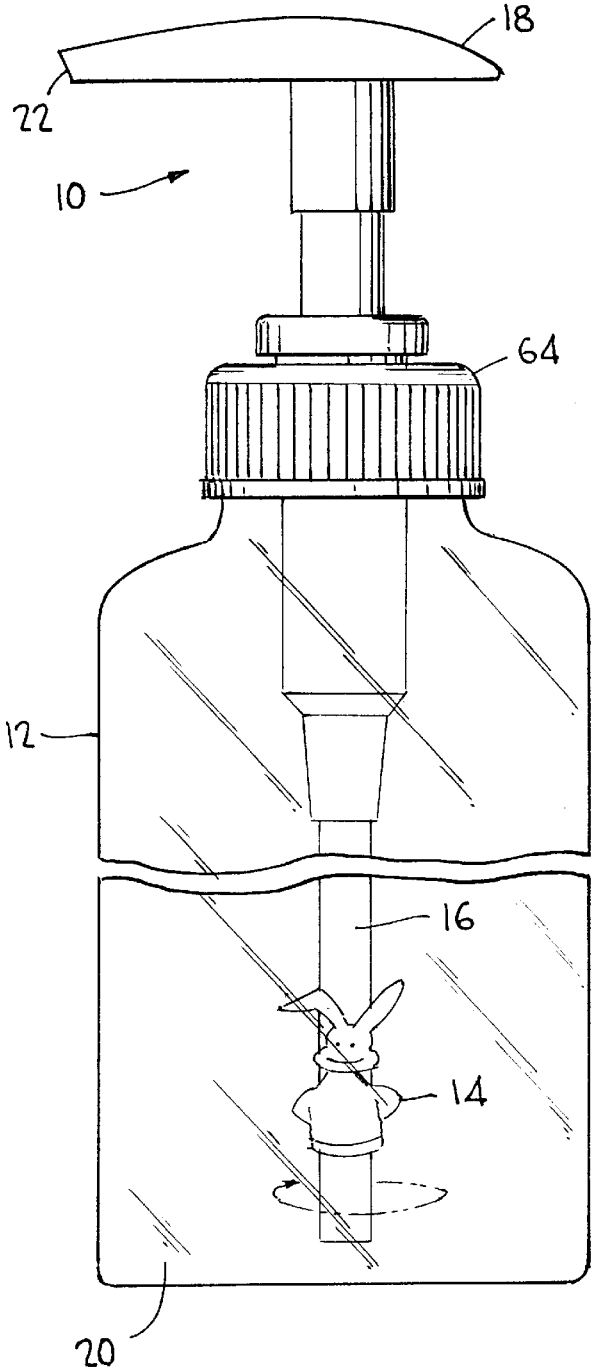
FIG.1 is a front view of a container including a fluid pump dispenser having a twirling dip tube according to the present invention, illustrating the plunger head in its rest configuration before beginning the pressure stroke.
Figure 5:
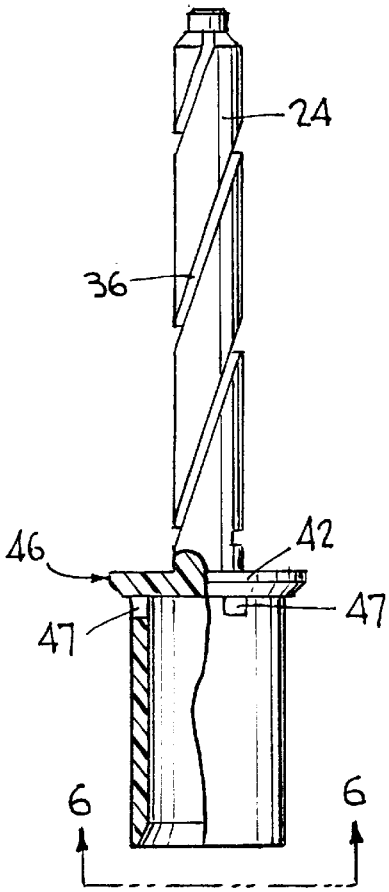
FIG. 5 is a front view of a spindle provided with the fluid pump dispenser of FIG. 1, including a partial cutout view of the frusto-conical surface of a frusto-conical seal.
Figure 6:
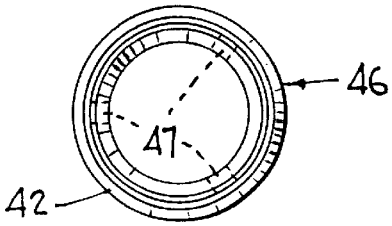
FIG. 6 is a bottom view of the spindle of FIG. 5, illustrating the location of fluid passages.

Referring now to the drawings wherein like reference numerals designate corresponding parts throughout the several views, FIGS. 1–6 illustrate a fluid pump dispenser (hereinafter pump dispenser) according to the present invention, generally designated 10.

Before proceeding further with a description of pump dispenser 10, the general operation of pump dispenser 10 will be briefly described in conjunction with exemplary container 12, so as to provide a basis for the forthcoming detailed description of pump dispenser 10.

Referring to FIG. 1, pump dispenser 10 may be mounted on container 12 and include a figurine 14 affixed to dip tube 16 defining an inlet passage 17. When plunger head 18 is pressed downward in the conventional manner, appropriate fluid 20, i.e. a high viscosity fluid such as soap or another low viscosity fluid, disposed in container 12 may exit through discharge spout 22. During the downward stroke of plunger head 18, figurine 14 may twirl in a predetermined direction and thereafter twirl in the opposite direction upon the release and ensuing upward movement of plunger head 18.

Referring now to FIGS. 2–6, pump dispenser 10 will be described in detail.

Figure 2:
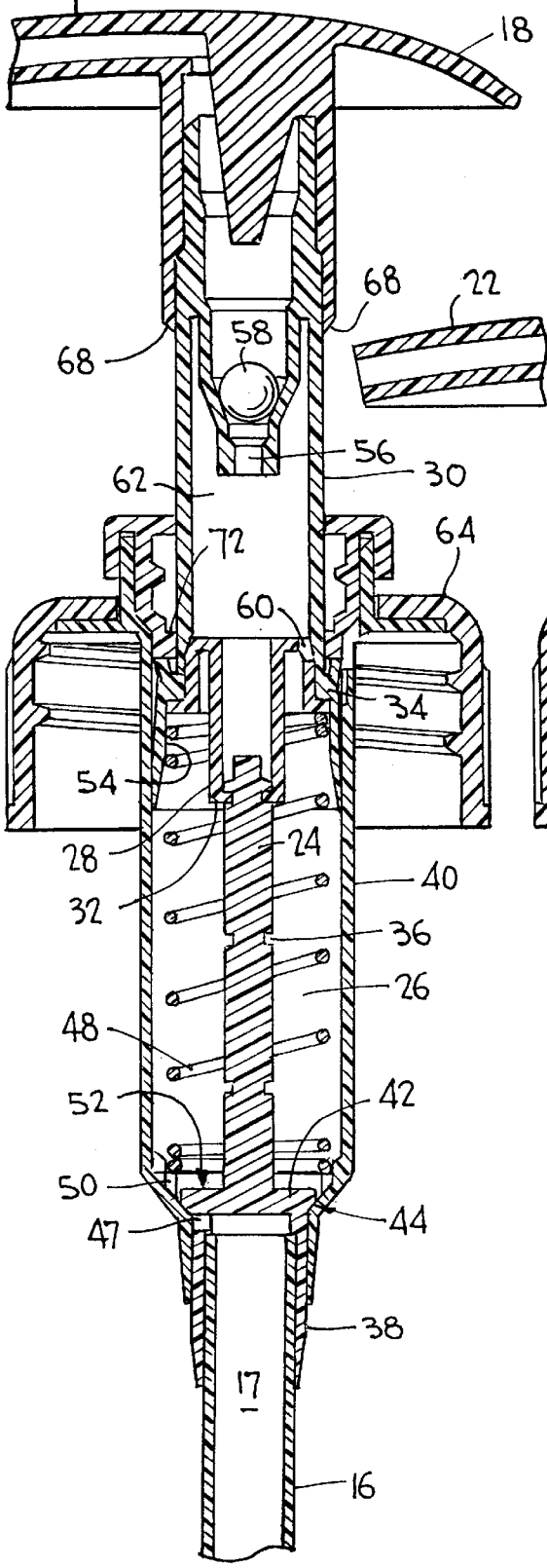
FIG. 2 is a partial sectional view of the fluid pump dispenser of FIG. 1, taken along a plane parallel to the front view of FIG. 1 and disposed at the central longitudinal axis of the dip tube, illustrating the pump piston and frusto-conical seal in their rest configuration, and the frusto-conical seal during the pressure stroke.
Figure 3:
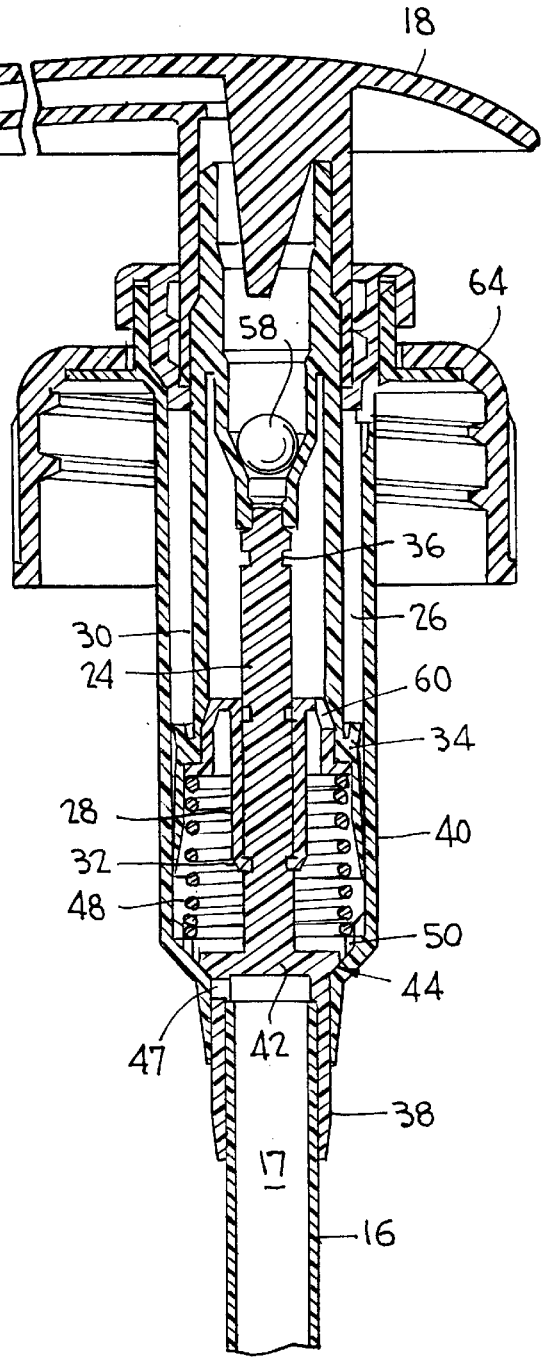
FIG. 3 is a partial sectional view of the fluid pump dispenser of FIG. 1, taken along a plane parallel to the front view of FIG. 1 and disposed at the central longitudinal axis of the dip tube, illustrating the pump piston and frusto-conical seal at the end of the pressure stroke.
Figure 4:
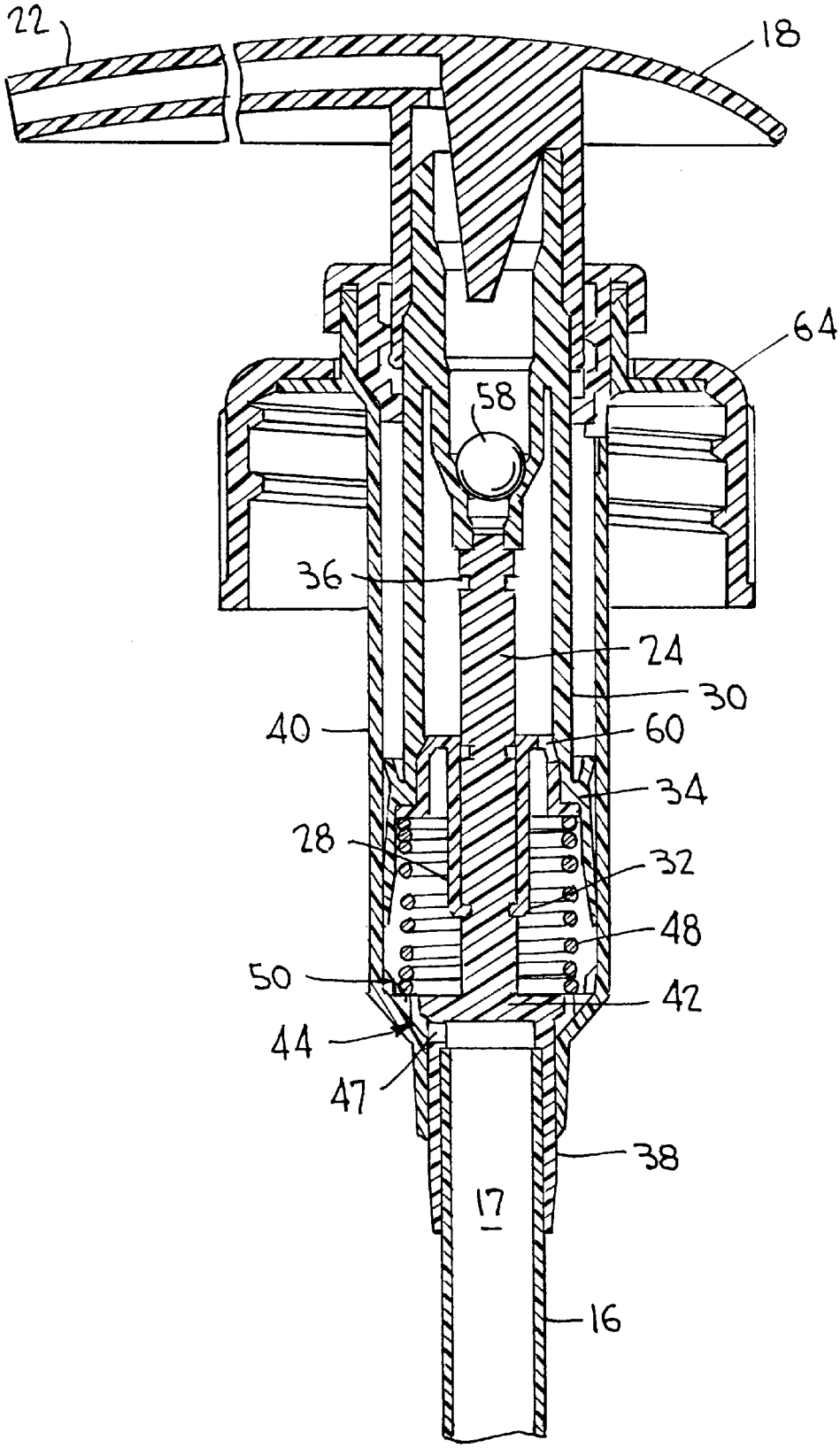
FIG. 4 is a partial sectional view of the fluid pump dispenser of FIG. 1, taken along a plane parallel to the front view of FIG. 1 and disposed at the central longitudinal axis of the dip tube, illustrating the pump piston and frusto-conical seal just after the beginning of the upstroke (i.e. return stroke or suction stroke)

Specifically, as shown in FIGS. 2–4, pump dispenser 10 may include a spindle 24 projecting into pump chamber (i.e. accumulator) 26 and providing a valve controlled inlet passage from dip tube 16 into pump chamber 26. A driver nut 28 including an engagement flange 32 may be provided concentric with pump piston 34 affixed to the bottom end of hollow stem 30 continuously defining a discharge passage 62 and operatively engaged with spiral turns 36 of spindle 24. In this manner, during the pressure stroke in which pump piston 34 moves downward along the axial direction of pump cylinder 40, driver nut 28 rotates spindle 24 and dip tube 16, which is operatively connected to spindle 24 by collar 38. Those skilled in the art will appreciate in view of this disclosure that collar 38 may be formed with spindle 24, or instead, may be formed separately and thereafter affixed to spindle 24. Likewise, driver nut 28 may be formed integrally with pump piston 34, or instead, may be formed separately and thereafter affixed to pump piston 34. The lower end of spindle 24 may include frusto-conical seal 42 formed therewith for sealing complementary valve seat 44 of pump chamber 26 and thus providing the valve controlled inlet passage from dip tube 16 into pump chamber 26. Frusto-conical seal 42 may include a chamfered edge 46 for permitting passage of fluid 20 through inlet port 47 during the ensuing return stroke of pump piston 34, as described in greater detail below. One or more inlet ports 47 in fluid communication with dip tube 16 may be provided below frusto-conical seal 42 for permitting passage of fluid 20 from container 12 into pump chamber 26 via chamfered edge 46.

A return spring 48 may be provided for positively biasing the automatic return of pump piston 34 to the rest configuration illustrated in FIG. 2. Return spring 48 may also be configured to provide a predetermined negative bias during the initial pressure stroke of pump piston 34, so as to control the rotation speed of dip tube 16 and/or to provide a means for controlling the amount of fluid dispensed through discharge spout 22. The bottom-most coil of spring 48 may be disposed in contiguous engagement with nib 50 to maintain the bottom-most coil at a predetermined distance from upper surface 52 of frusto-conical seal 42 at rest and during the pressure stroke of pump piston 34, as illustrated in FIGS. 2 and 3, respectively. The upper-most coil of spring 48 may be disposed within circular channel 54 of pump piston 34 and frictionally and/or otherwise mechanically retained therein. One or more outlet ports 60 in fluid communication with pump chamber 26 may be provided adjacent an upper surface of circular channel 54 for permitting passage of fluid from pump chamber 26 to outlet passage 56.

Outlet passage 56 may be controlled by a ball check valve 58 or the like. Outlet passage 56 may further be in fluid communication with discharge passage 62 to pump fluid through discharge spout 22 during the pressure stroke of pump piston 34. Pump dispenser 10 may be mounted onto container 12 by means of a standard internally threaded closure cap 64.

The aforementioned components of pump dispenser 10 may be made of plastic, ceramic, metal and the like.

The operation of pump dispenser 10 will now be described in detail.

Specifically, as illustrated in FIGS. 1 and 2, in the configuration with pump piston 34 and frusto-conical seal 42 at the beginning of the pressure stroke (i.e. at rest), pump dispenser 10 may include engagement flange 32 for driver nut 28 in the topmost position of spiral turns 36 of spindle 24. At the beginning of the pressure stroke, frusto-conical seal 42 may be disposed in sealing engagement with valve seat 44 of pump chamber 26. Thus, the length of spindle 24 may be provided such that, at rest, when spring 48 biases pump piston 34 and driver nut 28 upwards, frusto-conical seal 42 remains in sealing engagement with valve seat 44 of pump chamber 26 to prevent passage of fluid 20 from pump chamber 26 back into container 12.

Thereafter, during the pressure stroke when plunger head 18 is pressed downwards, while frusto-conical seal 42 remains in sealing contact with valve seat 44 of pump chamber 26, ball check valve 58 begins to move upwards to allow fluid 20 to enter outlet passage 56 and discharge through discharge spout 22. It should be noted that in transition from the rest configuration at the beginning of the pressure stroke (i.e. FIG. 2), where frusto-conical seal 42 is disposed in sealing engagement with valve seat 44 of pump chamber 26, to the end of the pressure stroke (i.e. FIG. 3), frusto-conical seal 42 remains in sealing engagement with valve seat 44 of pump chamber 26 and prevents passage of fluid 20 from dip tube 16 into pump chamber 26, as well as the leakage of fluid 20 present in pump chamber 26 back into dip tube 16.

During translation from rest to the end of the pressure stroke, as illustrated in FIGS. 2 and 3, respectively, engagement flange 32 travels downward in the pathway created by-spiral turns 36. At the same time, as engagement flange 32 travels downward, dip tube: 16 may rotate in a first direction to rotate figurine 14 therewith. Those skilled in the art will appreciate in view of this disclosure that spiral turns 36 of spindle 26 may be designed such that dip tube 16 and associated figurine 14 rotate in the desired direction and at a desired rotational speed. While engagement flange 32 travels downward, any fluid 20 present in pump chamber 26 may be discharged through discharge spout 22 via outlet port 60 and discharge passage 62. During translation from the beginning of the pressure stroke (i.e. FIG. 2) to the end of the pressure stroke (i.e. FIG. 3), ball check valve 58 may completely disengage by moving upward from its position shown in FIG. 2 to allow the passage of fluid 20 through outlet passage 56.

Referring next to FIG. 3, at the end of the pressure stroke of pump piston 34, frusto-conical seal 42 may remain in contact with valve seat 44 of pump chamber 26 to seal the chamber. As respectively illustrated in FIGS. 2 and 3, from rest to the end of the pressure stroke of pump piston 34, the bottom-most coil of return spring 48 may also remain at a predetermined distance away from upper surface 52 of frusto-conical seal 42, the distance being defined by the vertical thickness of nib 50. Thus the downward travel depth of plunger head 18 and associated components may be controlled by the compressed length of spring 48. Alternatively, those skilled in the art will appreciate in view of this disclosure that the downward travel depth of plunger head 18 may be controlled by the mating engagement between complementary surfaces 68 and 72 provided on pump dispenser 10.

After discharge of fluid 20 present in pump chamber 26, plunger head 18 may be released to automatically translate from its position at the end of the pressure stroke (i.e. FIG. 3) back to the rest position at the beginning of the pressure stroke (i.e. FIG. 2) under the bias of spring 48. Specifically, just after discharge of fluid 20 and release of plunger head 18, as illustrated in FIG. 4, frusto-conical seal 42 may elevate dip tube 16 a predetermined distance defined by the thickness of nib 50 under the bias of spring 48 until upper surface 52 of frusto-conical seal 42 bears against the lowermost coil of spring 48. In this manner, as engagement flange 32 continues to travel upward on spiral turns 36 of spindle 24, fluid may enter into pump chamber 26 from dip tube 16, through inlet port 47 and by chamfered edge 46 of frusto-conical seal 42. At the same time, as flange 32 travels upward on spiral turns 36, figurine 14 may rotate in a direction opposite to the direction of rotation during downward travel of flange 32. At the end of the return stroke, pump piston 34 and frusto-conical seal 42 may return to their axial positions illustrated in FIG. 2, with frusto-conical seal 42 resealing pump chamber 26.

Once plunger head 18 reaches the rest position at the beginning of the pressure stroke (i.e. FIGS. 1 and 2), plunger head 18 may be repeatedly pressed and released, as discussed above, to discharge fluid through discharge spout 22 and to rotate figurine 14 as desired.

Those skilled in the art will appreciate in view of this disclosure that the twirling action provided by figurine 14 may be utilized for entertainment purposes, as well as for stirring or otherwise disturbing fluid 20 in container 12. Accordingly, it is foreseeable that fluid 20 may be provided with a variety of reflective objects such that the twirling action provided by figurine 14 acts to disturb such objects, and thus provide further entertainment.

For the configurations of pump dispenser 10 described above, it should be noted that instead of driver nut 28 operatively connected with external spiral turns 36 of spindle 24 as shown in FIG. 2, spindle 24 may be formed hollow with internal spiral turns (not shown). For a hollow spindle 24 including internal spiral turns, piston 34 may be provided with a flange (not shown) provided in operative engagement with internal spiral turns of spindle 24 to likewise rotate spindle 24 during reciprocation of pump piston 34. In yet another alternative configuration, instead of driver nut 28 and flange 32 provided in operative engagement with spiral turns 36 of spindle 24, piston 34 may be provided with a single or multiple flanges or protrusions (not shown) in operative engagement with spiral turns 36 of spindle 24. With regard to the above-identified alternative configurations, those skilled in the art will appreciate in view of this disclosure that various other types of means may be provided for operatively rotating spindle 24 and dip tube 16 during reciprocation of pump piston 34 in pump chamber 26. Spiral turns 36 of spindle 24 may also be designed in various configurations to operatively fully or partially rotate or vibrate dip tube 16 and figurine 14 therewith. It is also apparent that pump dispenser 10 may be utilized with a discharge head for spraying fluid through an orifice (not shown) instead of discharging fluid through discharge spout 22.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A fluid pump dispenser comprising:

a spring biased pump piston having a generally hollow stem and reciprocable between pressure and return strokes within a pump cylinder therewith defining a variable volume pump chamber for dispensing fluid through a discharge opening at an outer end of said stem, said stem defining a valve controlled discharge passage leading from said pump chamber to said discharge opening;

a driver nut mounted adjacent said pump piston and including at least one flange engaged with at least one respective spiral turn on a spindle disposed within said pump chamber to thereby rotate said spindle during reciprocation of said pump piston; and a dip tube disposable within a container and affixed to said spindle for rotation with said spindle.

2. A fluid pump dispenser according to claim 1, said spring for biasing said pump piston being disposed within said pump cylinder to negatively bias said pump piston during said pressure stroke and positively bias said pump piston during said return stroke.

3. A fluid pump dispenser according to claim 1, further comprising:

a frusto-conical seal disposed at an end of said spindle to define a valve for controlling an inlet passage extending into said pump cylinder and configured to prevent passage of fluid into said pump cylinder during said pressure stroke and enable passage of fluid into said pump cylinder during said return stroke.

4. A fluid pump dispenser according to claim 3, said frusto-conical seal being disposable in mating engagement with a complementary valve seat within said pump cylinder to prevent the passage of fluid into said pump cylinder during said pressure stroke.

5. A fluid pump dispenser according to claim 3, said spindle being reciprocable during said pressure and return strokes to respectively engage and disengage said frusto-conical seal from a complementary valve seat within said pump cylinder to respectively prevent the passage of fluid into said pump cylinder during said pressure stroke and enable the passage of fluid into said pump cylinder during said return stroke.

6. A fluid pump dispenser according to claim 5, said frusto-conical seal being engageable with a stop to thereby limit the reciprocation of said spindle during said return stroke.

7. A fluid pump dispenser according to claim 6, said stop being said spring for biasing said pump piston.

8. A fluid pump dispenser according to claim 1, said dip tube including a figurine mounted thereon for rotation with said spindle.

9. A fluid pump dispenser according to claim 8, said figurine being configured to disturb fluid in the container.

10. A fluid pump dispenser according to claim 1, said valve controlled discharge passage being controlled by a ball check valve.

11. A fluid pump dispenser comprising:

a spring biased piston having a generally hollow stem and reciprocable between pressure and return strokes within a pump cylinder therewith defining a variable volume pump chamber for dispensing fluid through a discharge opening at an outer end of said stem, said stem defining a valve controlled discharge passage leading from said pump chamber to said discharge opening;

means for rotating a spindle during reciprocation of said piston; and a dip tube affixed to said spindle for rotation with said spindle.

12. A fluid pump dispenser according to claim 11, said spring for biasing said piston being disposed within said pump cylinder to negatively bias said piston during said pressure stroke and positively bias said piston during said return stroke.

13. A fluid pump dispenser according to claim 11, further comprising:

means for preventing passage of fluid into said pump cylinder during said pressure stroke and enabling passage of fluid into said pump cylinder during said return stroke.

14. A fluid pump dispenser according to claim 13, said means for preventing passage of fluid into said pump cylinder including a seal disposable in mating engagement with a complementary valve seat within said pump cylinder to prevent the passage of fluid into said pump cylinder during said pressure stroke.

15. A fluid pump dispenser according to claim 13, said spindle being reciprocable during said pressure and return strokes to respectively engage and disengage said means for preventing passage of fluid into said pump cylinder from a complementary valve seat within said pump cylinder to respectively prevent the passage of fluid into said pump cylinder during said pressure stroke and enable the passage of fluid into said pump cylinder during said return stroke.

16. A fluid pump dispenser according to claim 15, said means for preventing passage of fluid into said pump cylinder being engageable with a stop to thereby limit the reciprocation of said spindle during said return stroke.

17. A fluid pump dispenser according to claim 16, said stop being said spring for biasing said piston.

18. A fluid pump dispenser according to claim 11, said dip tube including a figurine mounted thereon for rotation with said spindle.

19. A fluid pump dispenser according to claim 18, said fluid pump dispenser being mounted onto a container, said figurine being configured to disturb fluid in said container.

20. A fluid pump dispenser according to claim 11, said valve controlled discharge passage being controlled by a ball check valve.

21. A method of twirling a dip tube operatively connected to a spring biased piston in a fluid pump dispenser, said method comprising:

providing said spring biased piston having a generally hollow stem;

reciprocating said piston between pressure and return strokes within a pump cylinder therewith defining a variable volume pump chamber for dispensing fluid through a discharge opening at an outer end of said stem, said stem defining a valve controlled discharge passage leading from said pump chamber to said discharge opening;

providing means for rotating a spindle during reciprocation of said piston; and affixing said dip tube to said spindle for rotation with said spindle.

22. A method according to claim 21, further comprising:

providing said spring for biasing said piston within said pump cylinder to negatively bias said piston during said pressure stroke and positively bias said piston during said return stroke.

23. A method according to claim 21, further comprising:

providing means for preventing passage of fluid into said pump cylinder during said pressure stroke and enabling passage of fluid into said pump cylinder during said return stroke.

24. A method according to claim 23, said means for preventing passage of fluid into said pump cylinder including a seal disposable in mating engagement with a complementary valve seat within said pump cylinder to prevent the passage of fluid into said pump cylinder during said pressure stroke.

25. A method according to claim 23, further comprising:

reciprocating said spindle during said pressure and return strokes to respectively engage and disengage said means for preventing passage of fluid into said pump cylinder from a complementary valve seat within said pump cylinder to respectively prevent the passage of fluid into said pump cylinder during said pressure stroke and enable the passage of fluid into said pump cylinder during said return stroke.

26. A method according to claim 25, further comprising:

engaging said means for preventing passage of fluid into said pump cylinder with a stop to thereby limit the reciprocation of said spindle during said return stroke.

27. A method according to claim 26, said stop being said spring for biasing said piston.

28. A method according to claim 21, further comprising:

providing a figurine mounted on said dip tube for rotation with said spindle.

29. A fluid pump dispenser according to claim 28, further comprising:

mounting said fluid pump dispenser onto a container, said figurine being configured to disturb fluid in said container.

30. A method according to claim 21, further comprising:

controlling said valve controlled discharge passage by a ball check valve.

* * * * *